US012201232B1

(12) United States Patent
Andre

(10) Patent No.: US 12,201,232 B1
(45) Date of Patent: Jan. 21, 2025

(54) THIN REMOVABLE BEVERAGE COASTER FOR INSERTION OVER THE TOP OF A STEMWARE FOOT TO ABSORB AND MINIMIZE CONDENSATION

(71) Applicant: Greg Andre, North Reading, MA (US)

(72) Inventor: Greg Andre, North Reading, MA (US)

( * ) Notice: Subject to any disclaimer, the term of this patent is extended or adjusted under 35 U.S.C. 154(b) by 0 days.

(21) Appl. No.: 18/515,784

(22) Filed: Nov. 21, 2023

(51) Int. Cl.
*A47G 23/032* (2006.01)

(52) U.S. Cl.
CPC ..... *A47G 23/032* (2013.01)

(58) Field of Classification Search
CPC ..... A47G 23/032
See application file for complete search history.

(56) References Cited

U.S. PATENT DOCUMENTS 1,930,415 A * 10/1933 Cantine ..... A47G 23/032 215/394
2,006,238 A * 6/1935 Florman ..... A47G 23/032 215/394
2,017,168 A * 10/1935 Sanders ..... A47G 23/032 215/394
2,143,045 A * 1/1939 Wicks ..... A47G 23/032 215/394
6,877,705 B2 * 4/2005 Dauer ..... A47G 23/032 248/346.11
8,646,740 B1 * 2/2014 Nelson ..... A47G 23/0306 215/393
9,801,484 B2 * 10/2017 Dodd ..... F16B 47/003
11,266,258 B1 * 3/2022 Moon ..... A47G 23/0216
2005/0077447 A1 * 4/2005 Martindale-Sharp ..... A47G 23/032 248/346.11
2008/0128435 A1 * 6/2008 Hester ..... A47G 11/001 220/737
2008/0203264 A1 * 8/2008 Lombard ..... A47G 23/03 248/346.11
2011/0284712 A1 * 11/2011 Watkins ..... A47G 23/032 248/346.11
2013/0062494 A1 * 3/2013 Cecil ..... A47G 23/03 248/346.11
2014/0124639 A1 * 5/2014 Rader ..... A47G 23/03 248/346.11

FOREIGN PATENT DOCUMENTS

CA 2172464 A1 * 9/1997
DE 202010007870 U1 * 11/2010 ..... A47G 23/032
DE 202015103441 U1 * 11/2016
WO WO-2006056728 A1 * 6/2006 ..... A47G 23/032

* cited by examiner

*Primary Examiner* — Anita M King
(74) *Attorney, Agent, or Firm* — Daniel N. Smith

(57) ABSTRACT

A thin, flat, absorbent, removable beverage coaster for placement over the top of a stemware foot to absorb condensation trickling down from the stemware bowl. This reduces condensation for reaching the stemware user or the table surface.

21 Claims, 7 Drawing Sheets

THIN REMOVABLE BEVERAGE COASTER FOR INSERTION OVER THE TOP OF A STEMWARE FOOT TO ABSORB AND MINIMIZE CONDENSATION

FIELD OF THE INVENTION

This invention relates to a thin, removable beverage coaster for placement over the top of a stemware foot to absorb condensation.

BACKGROUND OF INVENTION

Individuals often prefer sipping chilled beverages from stemware glasses, which are designed to be held by the stem to avoid direct contact with the cold, condensation-prone bowl. This handling method keeps fingers from touching the coldest part of the stemware glass and prevents warming the drink.

Despite these measures, the external surface of the stemware's bowl frequently sweats with condensation, threatening the condition of the surfaces on which the glass is placed, such as bar tops or tables. To protect these surfaces, people commonly place coasters or napkins under the stemware's base, which serve to prevent water marks and absorb excess moisture.

Aside from their protective function, coasters and napkins are utilized as promotional items, often emblazoned with the branding of drink manufacturers who provide them to bars at no cost. However, those designed to prevent sticking of the stemware to the table surface, due to their intricate constructions, are less favored for advertising since they don't accommodate branding as effectively.

When serving beverages, bar staff typically carry these protective items separately, requiring a tray to transport multiple drinks and coasters together efficiently.

While coasters and napkins are effective in guarding surfaces against moisture from the stemware foot, they don't address the issue of condensation trickling down the bowl to the stem and the top of the base. This residual moisture can make holding the glass uncomfortable, chilling and dampening the hand. Furthermore, condensation can drip onto patrons or the table once the glass is picked up or tilted to take a drink from the stemware glass.

Therefore, there's a clear necessity for a specialized type of coaster designed to intercept and contain moisture as it runs from the bowl of stemware, absorbing it as it reaches the upper part of the foot, thereby enhancing the drinking experience.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially diagonal radial slit extending from a first opening on the external side edge to a second opening on the internal side edge into the centralized opening; at least one substantially straight radial perforated slit extending from the internal side edge of the centralized opening to a position on the body of the coaster between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the straight radial perforated slit expands to permit that body of the coaster to sit substantially flat on the top surface of the foot of the stemware glass.

In further embodiments of the subject invention, the shape of the body is selected from a group consisting of substantially circular, semi-circular, oval, elliptical, triangular, rectangular, pentagonal, trapezoidal, rhombus, hexagonal, heptagonal, and octagonal.

In other embodiments of the subject invention, the shape of the centralized opening is selected from a group consisting of substantially circular, semi-circular, oval, elliptical, triangular, rectangular, pentagonal, trapezoidal, rhombus, hexagonal, heptagonal, and octagonal.

In additional embodiments of the subject invention, the body is composed of a fluid absorbing material.

In further embodiments of the subject invention, the body is composed of absorbing material selected from the group consisting of paper, cardboard, cork, wood, wood pulp, cotton, felt, cloth, rubber, sponge, and synthetic fibers.

In additional embodiments of the subject invention, the top surface comprises printed indicia selected from the group consisting of pictures, logos, colors, cartoon images, photographic images, game images, reflective materials, florescent materials, and advertisements.

In further embodiments of the subject invention, the bottom surface comprises printed indicia selected from the group consisting of pictures, logos, colors, cartoon images, photographic images, game images, reflective materials, florescent materials, and advertisements.

In other embodiments of the subject invention, the coaster is configured to fit all stemware.

In other embodiments of the subject invention, wherein the straight radial perforated channel expands to permit that body of the coaster to fit the diameters of stems of all stemware.

In further embodiments of the subject invention, the coaster is re-useable.

In additional embodiments of the subject invention, the coaster is disposable after one use.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially diagonal radial channel extending from a first opening on the external side edge to a second opening the internal side edge into the centralized cavity; at least one substantially straight radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the diagonal radial channel, such that the bottom surface of the coaster rests on a top surface of a foot of the stemware glass and the internal side edge of the centralized cavity surrounds the stem; and wherein the straight radial perforated channel expands to permit that body of the coaster to sit substantially flat on the top surface of the foot of the stemware glass.

In further embodiments of the subject invention, the shape of the body is selected from a group consisting of substantially circular, semi-circular, oval, elliptical, triangular, rectangular, pentagonal, trapezoidal, rhombus, hexagonal, heptagonal, and octagonal.

In other embodiments of the subject invention, the shape of the centralized cavity is selected from a group consisting of substantially circular, semi-circular, oval, elliptical, triangular, rectangular, pentagonal, trapezoidal, rhombus, hexagonal, heptagonal, and octagonal.

In additional embodiments of the subject invention, the body is composed of a fluid absorbing material.

In further embodiments of the subject invention, the body is composed of absorbing material selected from the group consisting of paper, cardboard, cork, wood, wood pulp, cotton, felt, cloth, rubber, sponge, and synthetic fibers.

In additional embodiments of the subject invention, the top surface comprises printed indicia selected from the group consisting of pictures, logos, colors, cartoon images, photographic images, game images, reflective materials, florescent materials, and advertisements.

In further embodiments of the subject invention, the bottom surface comprises printed indicia selected from the group consisting of pictures, logos, colors, cartoon images, photographic images, game images, reflective materials, florescent materials, and advertisements.

In other embodiments of the subject invention, the coaster is configured to fit all stemware.

In other embodiments of the subject invention, wherein the straight radial perforated channel expands to permit that body of the coaster to fit the diameters of stems of all stemware.

In additional embodiments of the subject invention, the coaster is re-useable.

In further embodiments of the subject invention, the coaster is disposable after one use.

The subject invention further discloses a coaster configured for stemware glasses, the coaster comprising a substantially planar body with a substantially flat top, a substantially flat bottom surface, an outer edge, an opening with an inner edge; a substantially diagonal slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a curved radial slit extending from a first opening on the external side edge to a second opening on the internal side edge into the centralized opening; at least one substantially straight radial perforated slit extending from the internal side edge of the centralized opening to a position on the body of the coaster between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the straight radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially curved radial channel extending from a first opening on the external side edge to a second opening the internal side edge into the centralized cavity; at least one substantially straight radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the curved radial channel, such that the bottom surface of the coaster rests on a top surface of a foot of the stemware glass and the internal side edge of the centralized cavity surrounds the stem; and wherein the straight radial perforated channel expands to permit that body of the coaster to sit substantially flat on the top surface of the foot of the stemware glass.

The subject invention discloses a coaster configured for stemware glasses, the coaster comprising a substantially planar body with a substantially flat top, a substantially flat bottom surface, an outer edge, an opening with an inner edge; a substantially curved slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially slanted radial slit extending from a first opening on the external side edge to a second opening on the internal side edge into the centralized opening; at least one substantially straight radial perforated slit extending from the internal side edge of the centralized opening to a position on the body of the coaster between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the straight radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially slanted radial channel extending from a first opening on the external side edge to a second opening the internal side edge into the centralized cavity; at least one substantially straight radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the slanted radial channel, such that the bottom surface of the coaster rests on a top surface of a foot of the stemware glass and the internal side edge of the centralized cavity surrounds the stem; and wherein the straight radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially slanted slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially straight radial slit extending from a first opening on the external side edge to a second opening on the internal side edge into the centralized opening; at least one substantially straight radial perforated slit extending from the internal side edge of the centralized opening to a position on the body of the coaster between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the straight radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially straight radial channel extending from a first opening on the external side edge to a second opening the internal side edge into the centralized cavity; at least one substantially straight radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the straight radial channel, such that the bottom surface of the coaster rests on a top surface of a foot of the stemware glass and the internal side edge of the centralized cavity surrounds the stem; and wherein the straight radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially straight slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially diagonal radial slit extending from a first opening on the external side edge to a second opening on the internal side edge into the centralized opening; at least one substantially slanted radial perforated slit extending from the internal side edge of the centralized opening to a position on the body of the coaster between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the slanted radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially diagonal radial channel extending from a first opening on the external side edge to a second opening the internal side edge into the centralized cavity; at least one substantially slanted radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the diagonal radial channel, such that the bottom surface of the coaster rests on a top surface of a foot of the stemware glass and the internal side edge of the centralized cavity surrounds the stem; and wherein the slanted radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially diagonal slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a curved radial slit extending from a first opening on the external side edge to a second opening on the internal side edge into the centralized opening; at least one substantially slanted radial perforated slit extending from the internal side edge of the centralized opening to a position on the body of the coaster between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the slanted radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially curved radial channel extending from a first opening on the external side edge to a second opening the internal side edge into the centralized cavity; at least one substantially slanted radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the curved radial channel, such that the bottom surface of the coaster rests on a top surface of a foot of the stemware glass and the internal side edge of the centralized cavity surrounds the stem; and wherein the slanted radial perforated channel expands to permit that body of the coaster to sit substantially flat on the top surface of the foot of the stemware glass.

The subject invention discloses a coaster configured for stemware glasses, the coaster comprising a substantially planar body with a substantially flat top, a substantially flat bottom surface, an outer edge, an opening with an inner edge; a substantially curved slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially slanted radial slit extending from a first opening on the external side edge to a second opening on the internal side edge into the centralized opening; at least one substantially slanted radial perforated slit extending from the internal side edge of the centralized opening to a position on the body of the coaster between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the slanted radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially slanted radial channel extending from a first opening on the external side edge to a second opening the internal side edge into the centralized cavity; at least one substantially slanted radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the slanted radial channel, such that the bottom surface of the coaster rests on a top surface of a foot of the stemware glass and the internal side edge of the centralized cavity surrounds the stem; and wherein the slanted radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially slanted slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially straight radial slit extending from a first opening on the external side edge to a second opening on the internal side edge into the centralized opening; at least one substantially slanted radial perforated slit extending from the internal side edge of the centralized opening to a position on the body of the coaster between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the slanted radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially straight radial channel extending from a first opening on the external side edge to a second opening the internal side edge into the centralized cavity; at least one substantially slanted radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the straight radial channel, such that the bottom surface of the coaster rests on a top surface of a foot of the stemware glass and the internal side edge of the centralized cavity surrounds the stem; and wherein the slanted radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially straight slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially diagonal radial slit extending from a first opening on the external side edge to a second opening on the internal side edge into the centralized opening; at least one substantially curved radial perforated slit extending from the internal side edge of the centralized opening to a position on the body of the coaster between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the curved radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially diagonal radial channel extending from a first opening on the external side edge to a second opening the internal side edge into the centralized cavity; at least one substantially curved radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the diagonal radial channel, such that the bottom surface of the coaster rests on a top surface of a foot of the stemware glass and the internal side edge of the centralized cavity surrounds the stem; and wherein the curved radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially diagonal slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a curved radial slit extending from a first opening on the external side edge to a second opening on the internal side edge into the centralized opening; at least one substantially curved radial perforated slit extending from the internal side edge of the centralized opening to a position on the body of the coaster between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the curved radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially curved radial channel extending from a first opening on the external side edge to a second opening the internal side edge into the centralized cavity; at least one substantially curved radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the curved radial channel, such that the bottom surface of the coaster rests on a top surface of a foot of the stemware glass and the internal side edge of the centralized cavity surrounds the stem; and wherein the curved radial perforated channel expands to permit that body of the coaster to sit substantially flat on the top surface of the foot of the stemware glass.

The subject invention discloses a coaster configured for stemware glasses, the coaster comprising a substantially planar body with a substantially flat top, a substantially flat bottom surface, an outer edge, an opening with an inner edge; a substantially curved slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially slanted radial slit extending from a first opening on the external side edge to a second opening on the internal side edge into the centralized opening; at least one substantially curved radial perforated slit extending from the internal side edge of the centralized opening to a position on the body of the coaster between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the curved radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially slanted radial channel extending from a first opening on the external side edge to a second opening the internal side edge into the centralized cavity; at least one substantially curved radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the slanted radial channel, such that the bottom surface of the coaster rests on a top surface of a foot of the stemware glass and the internal side edge of the centralized cavity surrounds the stem; and wherein the curved radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially slanted slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a coaster for stemware glasses, the coaster comprising: a substantially planar body with a substantially flat top surface, a substantially flat bottom surface, and an external side edge; the coaster further comprising a centralized opening with an internal side edge; a substantially straight radial slit extending from a first opening on the external side edge to a second opening on the internal side edge into the centralized opening; at least one substantially curved radial perforated slit extending from the internal side edge of the centralized opening to a position on the body of the coaster between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the curved radial perforated slit expands to permit that body of the coaster to sit substantially flat on the top surface of the foot of the stemware glass.

The subject invention also discloses a coaster for cradling the stem of a glass, the coaster comprising: a substantially planar, absorbent, and portable body with a substantially flat top surface, a substantially flat bottom surface, and an external side edge; the coaster further comprising a centralized cavity with an internal side edge; a substantially straight radial channel extending from a first opening on the external side edge to a second opening the internal side edge into the centralized cavity; at least one substantially curved radial perforated channel extending from the internal side edge of the centralized cavity to a position on the body of the coaster between the external side edge and the internal side edge of the centralized cavity; wherein the centralized cavity is configured to removably receive and hold a stem of a stemware glass through the straight radial channel, such that the bottom surface of the coaster rests on a top surface of a foot of the stemware glass and the internal side edge of the centralized cavity surrounds the stem; and wherein the curved radial perforated channel expands to permit that body of the coaster to sit substantially flat on the top surface of the foot of the stemware glass.

The subject invention further discloses a coaster configured for stemware glasses, the coaster comprising a substantially planar body with a substantially flat top, a substantially flat bottom surface, an outer edge, an opening with an inner edge; a substantially straight slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the coaster to rest on a foot of the glass, wherein the straight slit facilitates this snug fit, enabling the coaster to lie substantially flat on the foot.

The subject invention additionally discloses a coaster designed specifically for resting about the stem of a stemware glass, the coaster comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the coaster to rest on the stemware base, with the inner edge encircling the stem, wherein the straight, perforated channel helps the coaster align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially diagonal radial slit extending from a first opening on the external side edge to a second opening on the internal side edge into the centralized opening; at least one substantially straight radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the straight radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially diagonal radial channel extending from a first opening on the external side edge to a second opening the internal side edge into the centralized cavity; at least one substantially straight radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the diagonal radial channel, such that the bottom surface of the condensation absorbing accessory rests on a top surface of a foot of the stemware glass and the internal side edge of the centralized cavity surrounds the stem; and wherein the straight radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially diagonal slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a curved radial slit extending from a first opening on the external side edge to a second opening on the internal side edge into the centralized opening; at least one substantially straight radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the straight radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially curved radial channel extending from a first opening on the external side edge to a second opening the internal side edge into the centralized cavity; at least one substantially straight radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the curved radial channel, such that the bottom surface of the condensation absorbing accessory rests on a top surface of a foot of the stemware glass and the internal side edge of the centralized cavity surrounds the stem; and wherein the straight radial perforated channel expands to permit that body of the condensation absorbing accessory to sit substantially flat on the top surface of the foot of the stemware glass.

The subject invention discloses a condensation absorbing accessory configured for stemware glasses, the condensation absorbing accessory comprising a substantially planar body with a substantially flat top, a substantially flat bottom surface, an outer edge, an opening with an inner edge; a substantially curved slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially slanted radial slit extending from a first opening on the external side edge to a second opening on the internal side edge into the centralized opening; at least one substantially straight radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the straight radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially slanted radial channel extending from a first opening on the external side edge to a second opening the internal side edge into the centralized cavity; at least one substantially straight radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the slanted radial channel, such that the bottom surface of the condensation absorbing accessory rests on a top surface of a foot of the stemware glass and the internal side edge of the centralized cavity surrounds the stem; and wherein the straight radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially slanted slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially straight radial slit extending from a first opening on the external side edge to a second opening on the internal side edge into the centralized opening; at least one substantially straight radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the straight radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially straight radial channel extending from a first opening on the external side edge to a second opening the internal side edge into the centralized cavity; at least one substantially straight radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the straight radial channel, such that the bottom surface of the condensation absorbing accessory rests on a top surface of a foot of the stemware glass and the internal side edge of the centralized cavity surrounds the stem; and wherein the straight radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially straight slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially diagonal radial slit extending from a first opening on the external side edge to a second opening on the internal side edge into the centralized opening; at least one substantially slanted radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the slanted radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially diagonal radial channel extending from a first opening on the external side edge to a second opening the internal side edge into the centralized cavity; at least one substantially slanted radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the diagonal radial channel, such that the bottom surface of the condensation absorbing accessory rests on a top surface of a foot of the stemware glass and the internal side edge of the centralized cavity surrounds the stem; and wherein the slanted radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially diagonal slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a curved radial slit extending from a first opening on the external side edge to a second opening on the internal side edge into the centralized opening; at least one substantially slanted radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the slanted radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially curved radial channel extending from a first opening on the external side edge to a second opening the internal side edge into the centralized cavity; at least one substantially slanted radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the curved radial channel, such that the bottom surface of the condensation absorbing accessory rests on a top surface of a foot of the stemware glass and the internal side edge of the centralized cavity surrounds the stem; and wherein the slanted radial perforated channel expands to permit that body of the condensation absorbing accessory to sit substantially flat on the top surface of the foot of the stemware glass.

The subject invention discloses a condensation absorbing accessory configured for stemware glasses, the condensation absorbing accessory comprising a substantially planar body with a substantially flat top, a substantially flat bottom surface, an outer edge, an opening with an inner edge; a substantially curved slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially slanted radial slit extending from a first opening on the external side edge to a second opening on the internal side edge into the centralized opening; at least one substantially slanted radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the slanted radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially slanted radial channel extending from a first opening on the external side edge to a second opening the internal side edge into the centralized cavity; at least one substantially slanted radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the slanted radial channel, such that the bottom surface of the condensation absorbing accessory rests on a top surface of a foot of the stemware glass and the internal side edge of the centralized cavity surrounds the stem; and wherein the slanted radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially slanted slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially straight radial slit extending from a first opening on the external side edge to a second opening on the internal side edge into the centralized opening; at least one substantially slanted radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the slanted radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially straight radial channel extending from a first opening on the external side edge to a second opening the internal side edge into the centralized cavity; at least one substantially slanted radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the straight radial channel, such that the bottom surface of the condensation absorbing accessory rests on a top surface of a foot of the stemware glass and the internal side edge of the centralized cavity surrounds the stem; and wherein the slanted radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially straight slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially diagonal radial slit extending from a first opening on the external side edge to a second opening on the internal side edge into the centralized opening; at least one substantially curved radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the curved radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially diagonal radial channel extending from a first opening on the external side edge to a second opening the internal side edge into the centralized cavity; at least one substantially curved radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the diagonal radial channel, such that the bottom surface of the condensation absorbing accessory rests on a top surface of a foot of the stemware glass and the internal side edge of the centralized cavity surrounds the stem; and wherein the curved radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially diagonal slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a curved radial slit extending from a first opening on the external side edge to a second opening on the internal side edge into the centralized opening; at least one substantially curved radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the curved radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially curved radial channel extending from a first opening on the external side edge to a second opening the internal side edge into the centralized cavity; at least one substantially curved radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the curved radial channel, such that the bottom surface of the condensation absorbing accessory rests on a top surface of a foot of the stemware glass and the internal side edge of the centralized cavity surrounds the stem; and wherein the curved radial perforated channel expands to permit that body of the condensation absorbing accessory to sit substantially flat on the top surface of the foot of the stemware glass.

The subject invention discloses a condensation absorbing accessory configured for stemware glasses, the condensation absorbing accessory comprising a substantially planar body with a substantially flat top, a substantially flat bottom surface, an outer edge, an opening with an inner edge; a substantially curved slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially slanted radial slit extending from a first opening on the external side edge to a second opening on the internal side edge into the centralized opening; at least one substantially curved radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the curved radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially slanted radial channel extending from a first opening on the external side edge to a second opening the internal side edge into the centralized cavity; at least one substantially curved radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the slanted radial channel, such that the bottom surface of the condensation absorbing accessory rests on a top surface of a foot of the stemware glass and the internal side edge of the centralized cavity surrounds the stem; and wherein the curved radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially slanted slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a condensation absorbing accessory for stemware glasses, the condensation absorbing accessory comprising: a substantially planar body with a substantially flat top surface, a substantially flat bottom surface, and an external side edge; the condensation absorbing accessory further comprising a centralized opening with an internal side edge; a substantially straight radial slit extending from a first opening on the external side edge to a second opening on the internal side edge into the centralized opening; at least one substantially curved radial perforated slit extending from the internal side edge of the centralized opening to a position on the body of the condensation absorbing accessory between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the curved radial perforated slit expands to permit that body of the condensation absorbing accessory to sit substantially flat on the top surface of the foot of the stemware glass.

The subject invention also discloses a condensation absorbing accessory for cradling the stem of a glass, the condensation absorbing accessory comprising: a substantially planar, absorbent, and portable body with a substantially flat top surface, a substantially flat bottom surface, and an external side edge; the condensation absorbing accessory further comprising a centralized cavity with an internal side edge; a substantially straight radial channel extending from a first opening on the external side edge to a second opening the internal side edge into the centralized cavity; at least one substantially curved radial perforated channel extending from the internal side edge of the centralized cavity to a position on the body of the condensation absorbing accessory between the external side edge and the internal side edge of the centralized cavity; wherein the centralized cavity is configured to removably receive and hold a stem of a stemware glass through the straight radial channel, such that the bottom surface of the condensation absorbing accessory rests on a top surface of a foot of the stemware glass and the internal side edge of the centralized cavity surrounds the stem; and wherein the curved radial perforated channel expands to permit that body of the condensation absorbing accessory to sit substantially flat on the top surface of the foot of the stemware glass.

The subject invention further discloses a condensation absorbing accessory configured for stemware glasses, the condensation absorbing accessory comprising a substantially planar body with a substantially flat top, a substantially flat bottom surface, an outer edge, an opening with an inner edge; a substantially straight slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the condensation absorbing accessory to rest on a foot of the glass, wherein the straight slit facilitates this snug fit, enabling the condensation absorbing accessory to lie substantially flat on the foot.

The subject invention additionally discloses a condensation absorbing accessory designed specifically for resting about the stem of a stemware glass, the condensation absorbing accessory comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the condensation absorbing accessory to rest on the stemware base, with the inner edge encircling the stem, wherein the straight, perforated channel helps the condensation absorbing accessory align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially diagonal radial slit extending from a first opening on the external side edge to a second opening on the internal side edge into the centralized opening; at least one substantially straight radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the straight radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially diagonal radial channel extending from a first opening on the external side edge to a second opening the internal side edge into the centralized cavity; at least one substantially straight radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the diagonal radial channel, such that the bottom surface of the stemware glass foot cover rests on a top surface of a foot of the stemware glass and the internal side edge of the centralized cavity surrounds the stem; and wherein the straight radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially diagonal slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a curved radial slit extending from a first opening on the external side edge to a second opening on the internal side edge into the centralized opening; at least one substantially straight radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the straight radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially curved radial channel extending from a first opening on the external side edge to a second opening the internal side edge into the centralized cavity; at least one substantially straight radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the curved radial channel, such that the bottom surface of the stemware glass foot cover rests on a top surface of a foot of the stemware glass and the internal side edge of the centralized cavity surrounds the stem; and wherein the straight radial perforated channel expands to permit that body of the stemware glass foot cover to sit substantially flat on the top surface of the foot of the stemware glass.

The subject invention discloses a stemware glass foot cover configured for stemware glasses, the stemware glass foot cover comprising a substantially planar body with a substantially flat top, a substantially flat bottom surface, an outer edge, an opening with an inner edge; a substantially curved slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially slanted radial slit extending from a first opening on the external side edge to a second opening on the internal side edge into the centralized opening; at least one substantially straight radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the straight radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially slanted radial channel extending from a first opening on the external side edge to a second opening the internal side edge into the centralized cavity; at least one substantially straight radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the slanted radial channel, such that the bottom surface of the stemware glass foot cover rests on a top surface of a foot of the stemware glass and the internal side edge of the centralized cavity surrounds the stem; and wherein the straight radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially slanted slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially straight radial slit extending from a first opening on the external side edge to a second opening on the internal side edge into the centralized opening; at least one substantially straight radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the straight radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially straight radial channel extending from a first opening on the external side edge to a second opening the internal side edge into the centralized cavity; at least one substantially straight radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the straight radial channel, such that the bottom surface of the stemware glass foot cover rests on a top surface of a foot of the stemware glass and the internal side edge of the centralized cavity surrounds the stem; and wherein the straight radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially straight slit running from the outer edge to the inner edge of the opening; at least one substantially straight, perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one substantially straight, perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially diagonal radial slit extending from a first opening on the external side edge to a second opening on the internal side edge into the centralized opening; at least one substantially slanted radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the slanted radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially diagonal radial channel extending from a first opening on the external side edge to a second opening the internal side edge into the centralized cavity; at least one substantially slanted radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the diagonal radial channel, such that the bottom surface of the stemware glass foot cover rests on a top surface of a foot of the stemware glass and the internal side edge of the centralized cavity surrounds the stem; and wherein the slanted radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially diagonal slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a curved radial slit extending from a first opening on the external side edge to a second opening on the internal side edge into the centralized opening; at least one substantially slanted radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the slanted radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially curved radial channel extending from a first opening on the external side edge to a second opening the internal side edge into the centralized cavity; at least one substantially slanted radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the curved radial channel, such that the bottom surface of the stemware glass foot cover rests on a top surface of a foot of the stemware glass and the internal side edge of the centralized cavity surrounds the stem; and wherein the slanted radial perforated channel expands to permit that body of the stemware glass foot cover to sit substantially flat on the top surface of the foot of the stemware glass.

The subject invention discloses a stemware glass foot cover configured for stemware glasses, the stemware glass foot cover comprising a substantially planar body with a substantially flat top, a substantially flat bottom surface, an outer edge, an opening with an inner edge; a substantially curved slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially slanted radial slit extending from a first opening on the external side edge to a second opening on the internal side edge into the centralized opening; at least one substantially slanted radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the slanted radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially slanted radial channel extending from a first opening on the external side edge to a second opening the internal side edge into the centralized cavity; at least one substantially slanted radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the slanted radial channel, such that the bottom surface of the stemware glass foot cover rests on a top surface of a foot of the stemware glass and the internal side edge of the centralized cavity surrounds the stem; and wherein the slanted radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially slanted slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially straight radial slit extending from a first opening on the external side edge to a second opening on the internal side edge into the centralized opening; at least one substantially slanted radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the slanted radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially straight radial channel extending from a first opening on the external side edge to a second opening the internal side edge into the centralized cavity; at least one substantially slanted radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the straight radial channel, such that the bottom surface of the stemware glass foot cover rests on a top surface of a foot of the stemware glass and the internal side edge of the centralized cavity surrounds the stem; and wherein the slanted radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially straight slit running from the outer edge to the inner edge of the opening; at least one slanted radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one slanted radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially diagonal radial slit extending from a first opening on the external side edge to a second opening on the internal side edge into the centralized opening; at least one substantially curved radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the diagonal radial slit, such that the bottom surface rests on a top surface of a foot of the stemware glass and the internal side edge of the centralized opening surrounds the stem; and wherein the curved radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially diagonal radial channel extending from a first opening on the external side edge to a second opening the internal side edge into the centralized cavity; at least one substantially curved radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the diagonal radial channel, such that the bottom surface of the stemware glass foot cover rests on a top surface of a foot of the stemware glass and the internal side edge of the centralized cavity surrounds the stem; and wherein the curved radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially diagonal slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially diagonal channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a curved radial slit extending from a first opening on the external side edge to a second opening on the internal side edge into the centralized opening; at least one substantially curved radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the curved radial slit, such that the bottom surface rests on a top surface of a foot of the stemware glass and the internal side edge of the centralized opening surrounds the stem; and wherein the curved radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially curved radial channel extending from a first opening on the external side edge to a second opening the internal side edge into the centralized cavity; at least one substantially curved radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the curved radial channel, such that the bottom surface of the stemware glass foot cover rests on a top surface of a foot of the stemware glass and the internal side edge of the centralized cavity surrounds the stem; and wherein the curved radial perforated channel expands to permit that body of the stemware glass foot cover to sit substantially flat on the top surface of the foot of the stemware glass.

The subject invention discloses a stemware glass foot cover configured for stemware glasses, the stemware glass foot cover comprising a substantially planar body with a substantially flat top, a substantially flat bottom surface, an outer edge, an opening with an inner edge; a substantially curved slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially curved channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially slanted radial slit extending from a first opening on the external side edge to a second opening on the internal side edge into the centralized opening; at least one substantially curved radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the slanted radial slit, such that the bottom surface rests on a top surface of a foot of the stemware glass and the internal side edge of the centralized opening surrounds the stem; and wherein the curved radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially slanted radial channel extending from a first opening on the external side edge to a second opening the internal side edge into the centralized cavity; at least one substantially curved radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the slanted radial channel, such that the bottom surface of the stemware glass foot cover rests on a top surface of a foot of the stemware glass and the internal side edge of the centralized cavity surrounds the stem; and wherein the curved radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially slanted slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially slanted channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

The subject invention discloses a stemware glass foot cover, the stemware glass foot cover comprising: a substantially planar body with a substantially flat top surface, a substantially flat bottom surface, and an external side edge; the stemware glass foot cover further comprising a centralized opening with an internal side edge; a substantially straight radial slit extending from a first opening on the external side edge to a second opening on the internal side edge into the centralized opening; at least one substantially curved radial perforated slit extending from the internal side edge of the centralized opening to a position on the body of the stemware glass foot cover between the external side edge and the internal side edge of the centralized opening; wherein the centralized opening is configured to removably receive and hold a stem of a stemware glass through the straight radial slit, such that the bottom surface rests on a top surface of a foot of the stemware glass and the internal side edge of the centralized opening surrounds the stem; and wherein the curved radial perforated slit expands to permit that body of the stemware glass foot cover to sit substantially flat on the top surface of the foot of the stemware glass.

The subject invention also discloses a stemware glass foot cover for cradling the stem of a glass, the stemware glass foot cover comprising: a substantially planar, absorbent, and portable body with a substantially flat top surface, a substantially flat bottom surface, and an external side edge; the stemware glass foot cover further comprising a centralized cavity with an internal side edge; a substantially straight radial channel extending from a first opening on the external side edge to a second opening the internal side edge into the centralized cavity; at least one substantially curved radial perforated channel extending from the internal side edge of the centralized cavity to a position on the body of the stemware glass foot cover between the external side edge and the internal side edge of the centralized cavity; wherein the centralized cavity is configured to removably receive and hold a stem of a stemware glass through the straight radial channel, such that the bottom surface of the stemware glass foot cover rests on a top surface of a foot of the stemware glass and the internal side edge of the centralized cavity surrounds the stem; and wherein the curved radial perforated channel expands to permit that body of the stemware glass foot cover to sit substantially flat on the top surface of the foot of the stemware glass.

The subject invention further discloses a stemware glass foot cover configured for stemware glasses, the stemware glass foot cover comprising a substantially planar body with a substantially flat top, a substantially flat bottom surface, an outer edge, an opening with an inner edge; a substantially straight slit running from the outer edge to the inner edge of the opening; at least one curved radial perforated slit starting from the inner edge of the opening and stretching through the planar body, but not reaching the outer edge; wherein the opening is shaped to snugly fit and hold the stem of a stemware glass allowing the bottom surface of the stemware glass foot cover to rest on a foot of the glass, wherein the straight slit facilitates this snug fit, enabling the stemware glass foot cover to lie substantially flat on the foot.

The subject invention additionally discloses a stemware glass foot cover designed specifically for resting about the stem of a stemware glass, the stemware glass foot cover comprising a substantially flat, absorbent, and easily movable body, a substantially flat top, a substantially flat bottom, an outer edge, and a central cavity with an inner edge; the body further comprising a substantially straight channel running from an opening on the outer edge to another opening on the inner edge, leading into the cavity; at least one curved radial perforated channel starting from the inner edge of the central cavity and extending partway across the body; wherein the central cavity is shaped to temporarily hold a stemware glass stem, allowing the stemware glass foot cover to rest on the stemware base, with the inner edge encircling the stem, wherein the straight, perforated channel helps the stemware glass foot cover align substantially flatly on the base.

In embodiments of the subject invention, the term "substantially" is defined as at least close to (and can include) a given value or state, as understood by a person of ordinary skill in the art. In one embodiment, the term "substantially" refers to ranges within 10%, preferably within 5%, more preferably within 1%, and most preferably within 0.1% of the given value or state being specified.

In embodiments of the subject invention, the term "relatively" is defined as a comparison of a property, or the proportion of a property between two components.

BRIEF DESCRIPTION OF THE DRAWINGS

Advantages of the present invention will be apparent from the following detailed description of embodiments, which description should be considered in conjunction with the accompanying drawings, in which.

DETAILED DESCRIPTION OF THE EMBODIMENTS

While several variations of the present invention have been illustrated by way of example in particular embodiments, it is apparent that further embodiments could be developed within the spirit and scope of the present invention. However, it is to be expressly understood that such modifications and adaptations are within the spirit and scope of the present invention, and are inclusive, but not limited to the following appended claims as set forth.

Figure 1:
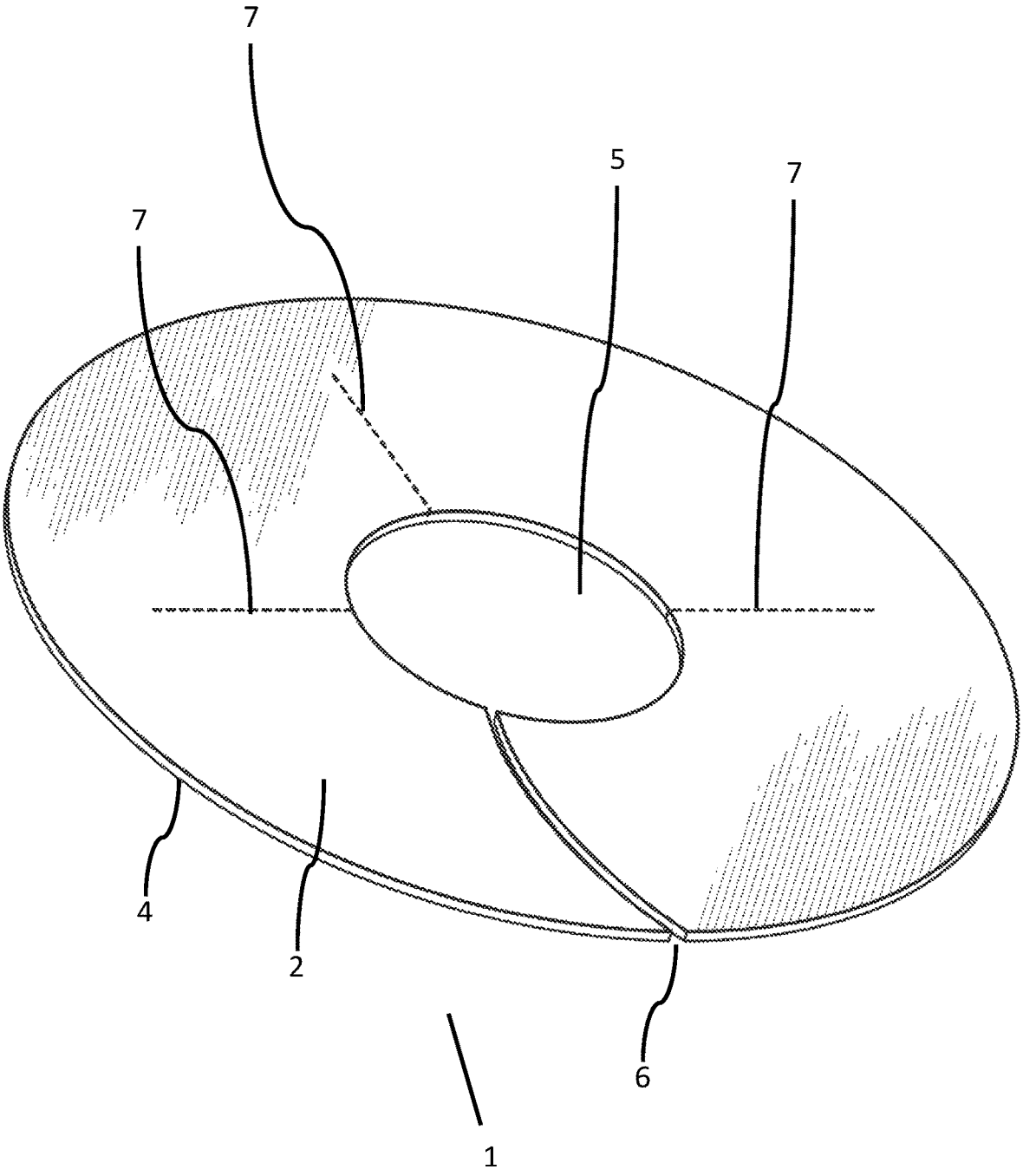
FIG. 1 Illustrates a perspective view of a thin, removable, beverage coaster for insertion over the top of a stemware foot to absorb and minimize condensation.
Figure 2:
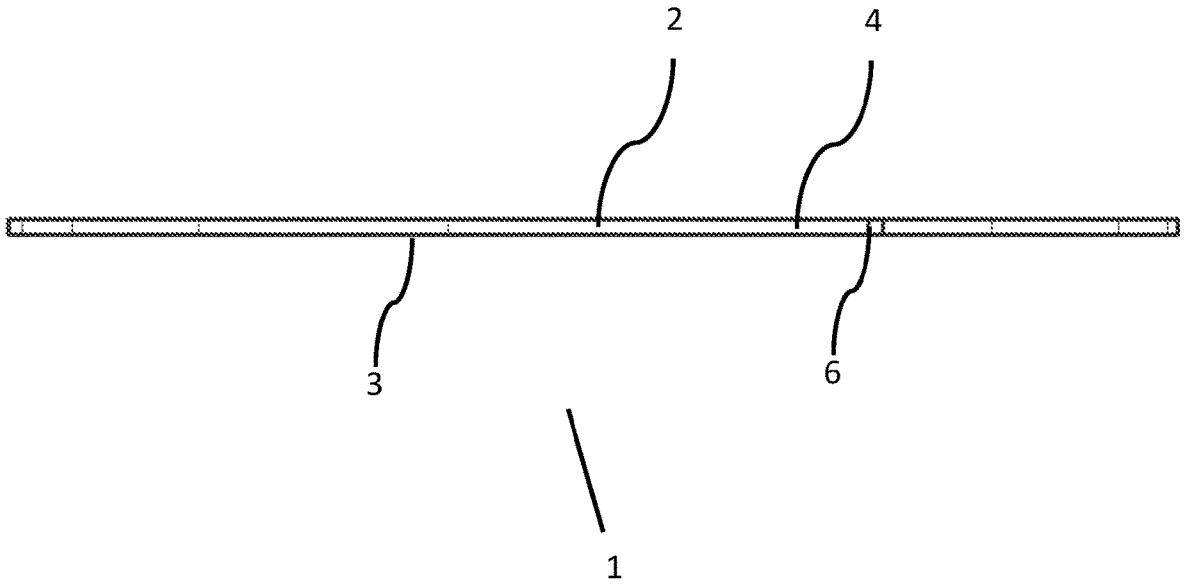
FIG. 2 Illustrates a front view of the beverage coaster.
Figure 3:
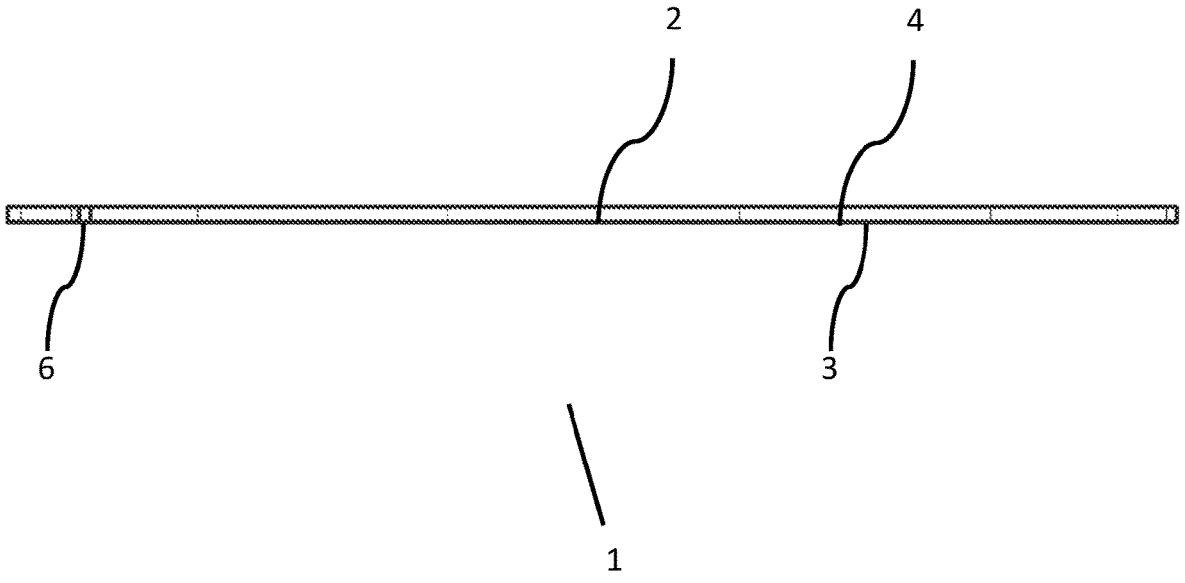
FIG. 3 Illustrates a right side view of the beverage coaster.
Figure 4:
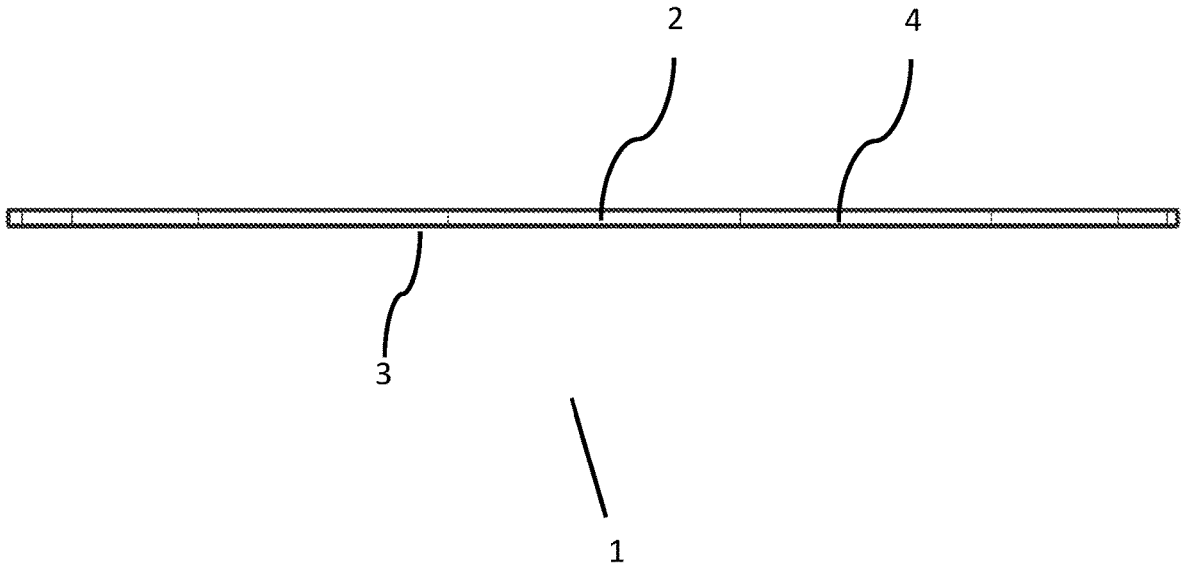
FIG. 4 Illustrates a left side view of the beverage coaster.
Figure 5:
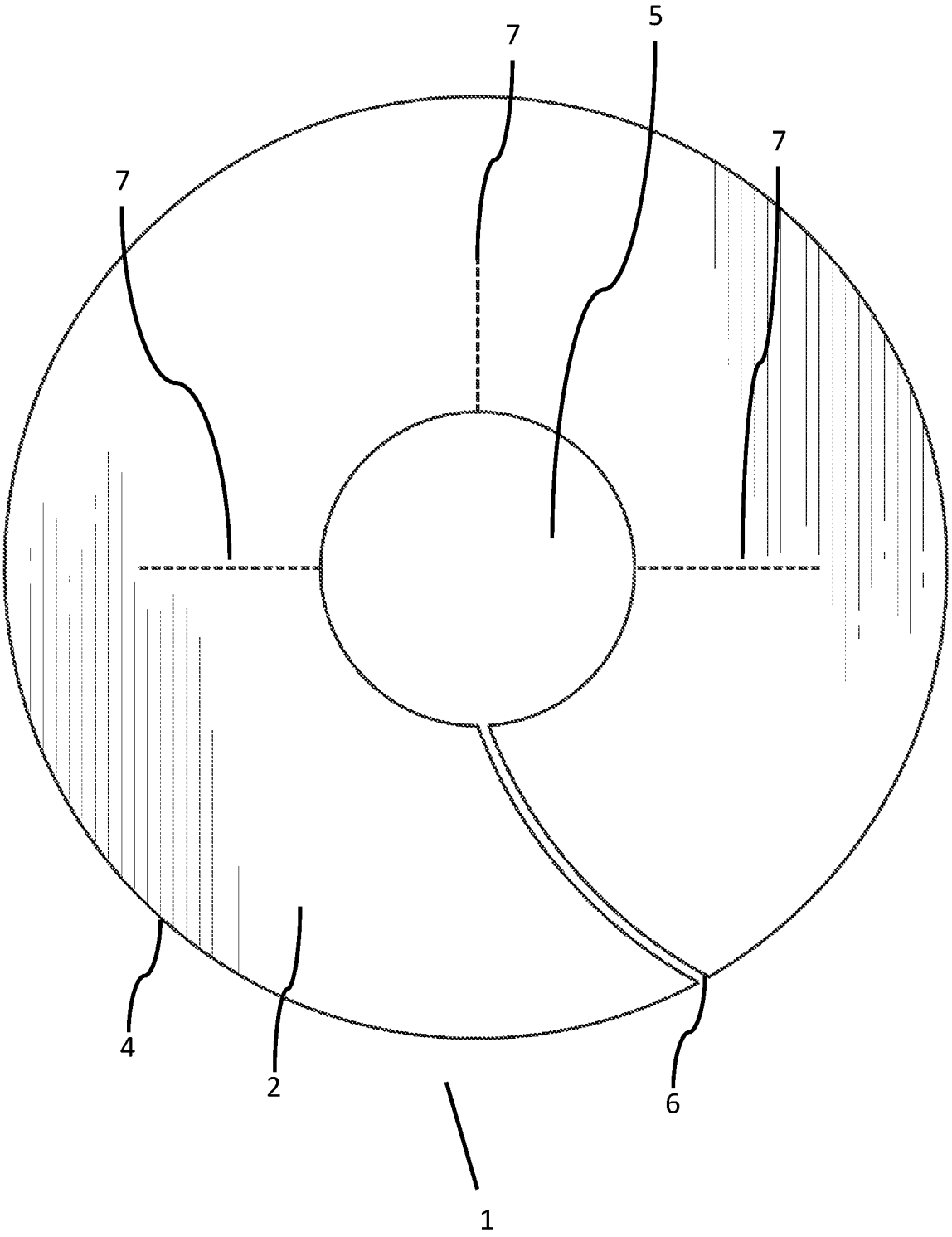
FIG. 5 Illustrates a top view of the beverage coaster.
Figure 6:
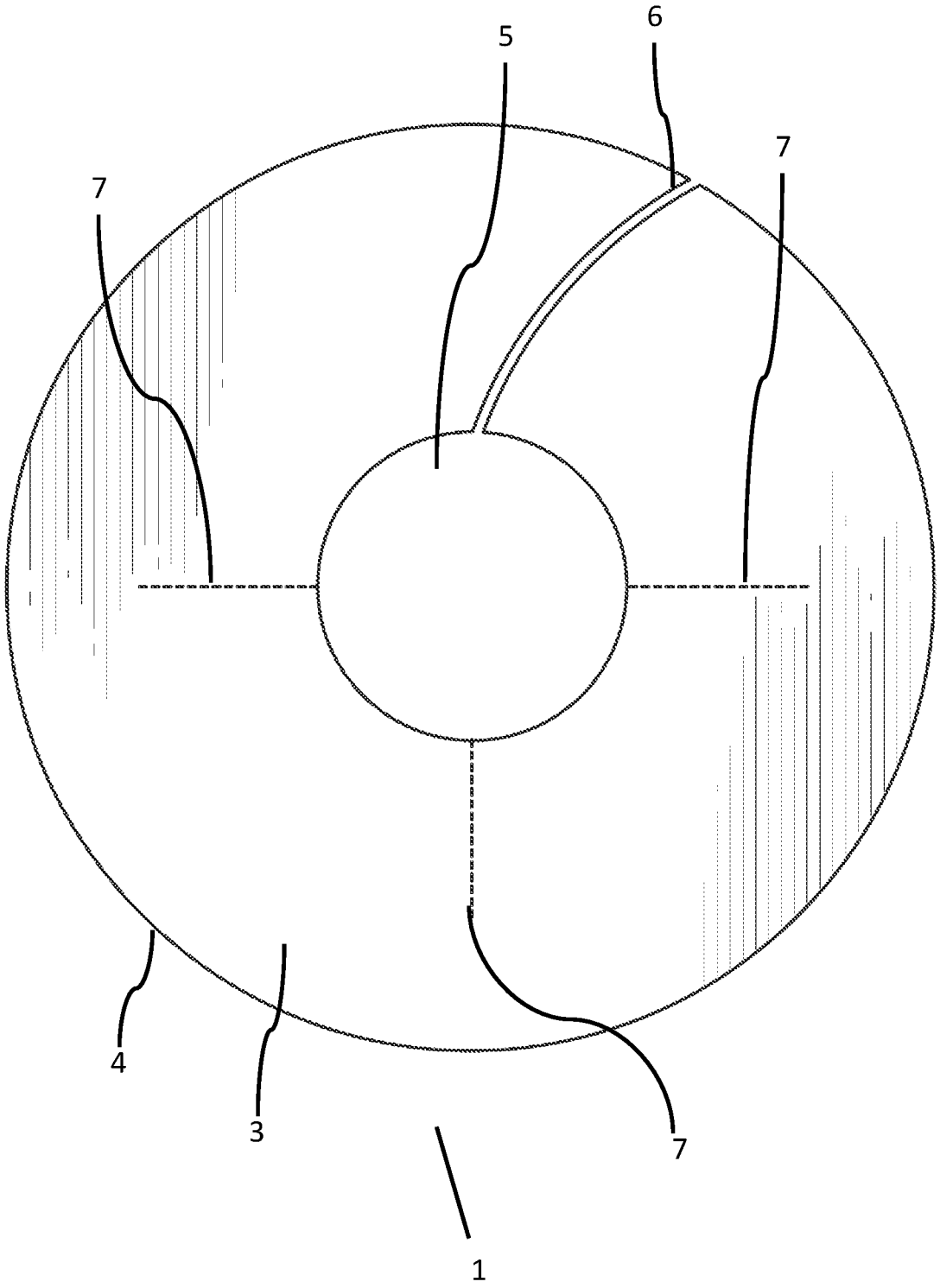
FIG. 6 Illustrates a bottom view of the beverage coaster.
Figure 7:
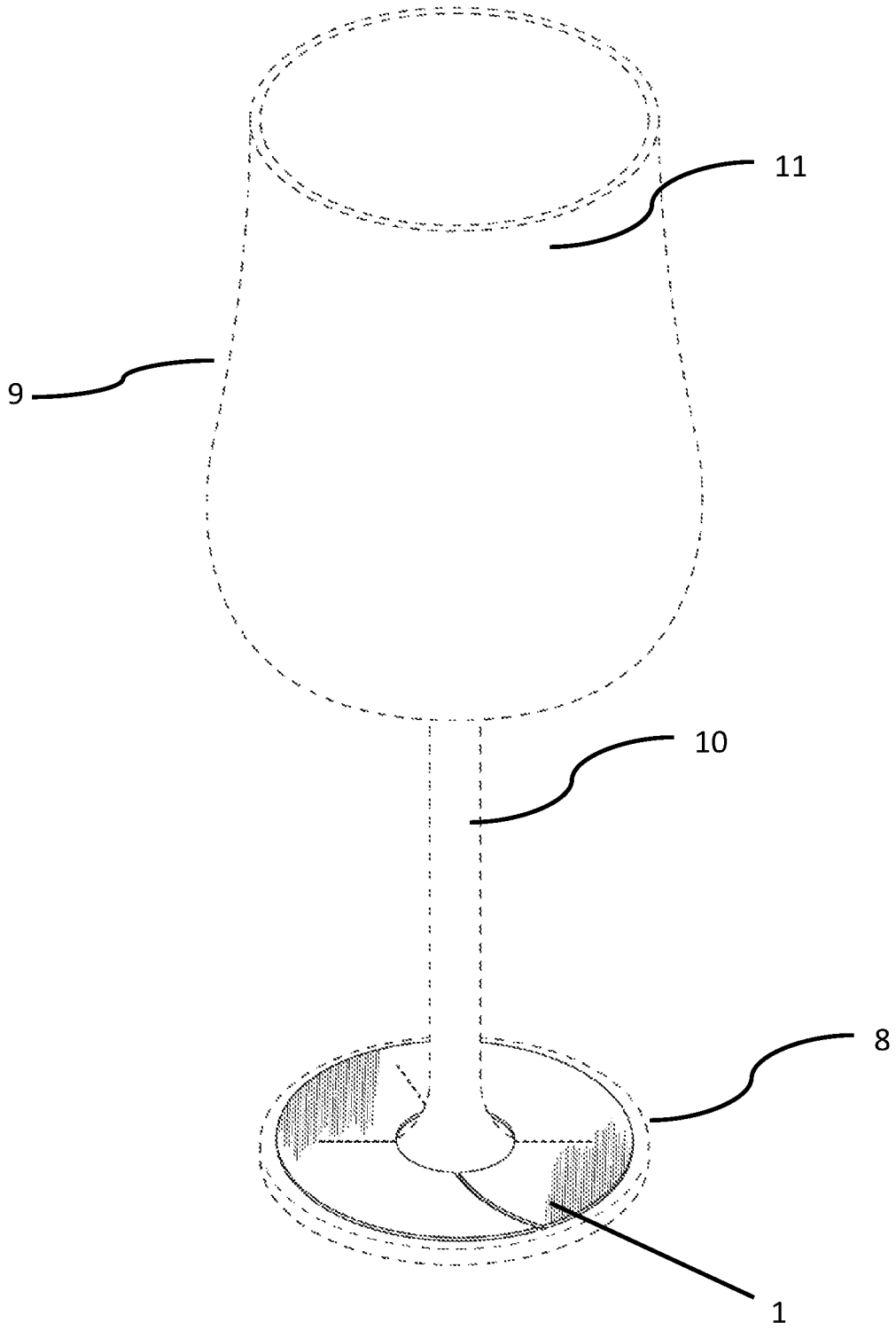
FIG. 7 Illustrates a perspective view of the beverage coaster placed over the stemware foot of a beverage glass, the broken lines shown in the Figure are included for the purpose of illustrating the beverage coaster when placed onto a stemware foot.

As illustrated in FIGS. 1-7, the subject invention is a thin, removable, disposable beverage coaster 1. Each coaster 1 contains a substantially flat top surface 2, a substantially flat bottom surface 3, a side edge 4, at central opening 5, a substantially diagonal radial slit 6, and at least one substantially straight radial perforated slit 7.

The coaster 1 is configured to place the bottom surface 3 over the foot 8 of a stemware glass 9 by inserting the stem 10 of the stemware glass 9 through the radial slit 6 so that the central opening surrounds the stem 10. The top surface 2 of the coaster 1 faces upwards from the foot 8 of the stemware glass 9. The perforated slits 7 expand to allow the top surface 2 of the coaster 1 to sit substantially flat on the foot 8 of the stemware glass 9. The perforated slits 7 expand to allow the top surface 2 of the coaster 1 to fit various diameters of different stems 10 of different stemware glasses 9.

As condensation trickles down the bowl 11 to the stem 10 and the top of the foot 8, this moisture is absorbed by the coaster 1. This absorption will make holding the glass comfortable, minimizing the amount water from reaching the hand. Furthermore, condensation will be prevented or reduced from dripping onto patrons or the table once the stemware glass 9 is picked up or tilted by the patron for taking a drink.

The coaster 1 may comprise a substantially circular shape. In other embodiments of the subject invention, the coaster 1 may have a shape that is substantially circular, semi-circular, oval, elliptical, triangular, rectangular, pentagonal, trapezoidal, rhombus, hexagonal, heptagonal, or octagonal. The coaster 1 may be multiple sizes, or one size configured to fit all stemware glasses. In embodiments of the subject invention, the coaster 1 may be 1.5" to 4" in diameter. The central opening 5 may be 0.5" to 1" in diameter. The radial perforated slit 7 may be 1/16" to ½" in length.

Each coaster 1 may be composed of soft, flexible, absorbing materials such as paper, cardboard, cork, wood, wood pulp, cotton, felt, cloth, rubber, sponge, and synthetic fibers. In alternative embodiments, the coaster 1 may be composed of as animal fabrics such as wool or silk; animal skin, such as leather or fur; plant fabrics such as cotton, modal, or hemp; or synthetic materials such as nylon, polyester, aramid, olefin, acrylic, or synthetic leather, vinyl polymers, or soft plastic materials. In additional embodiments of the subject invention, the coaster 1 may be composed of a translucent material such as translucent plastic, a vinyl polymer, or a combination thereof material. The coaster 1 may be re-useable or composed of one-use disposable materials.

The coaster 1 may contain printed indicia on the top surface 2 or bottom surface 3, such indicia may include, but is not limited to: pictures, logos, colors, cartoon images, photographic images, game images, reflective materials, florescent materials, or advertisements.

What is claimed is:

1. A coaster for stemware glasses, the coaster comprising:

a substantially planar body with a substantially flat top surface, a substantially flat bottom surface, and an external side edge;

the coaster further comprising a centralized opening with an internal side edge;

a substantially diagonal radial slit extending from a first opening on the external side edge to a second opening on the internal side edge into the centralized opening;

at least one substantially straight radial perforated slit extending from the internal side edge of the centralized opening to a position on the body of the coaster between the external side edge and the internal side edge of the centralized opening;

wherein the centralized opening is configured to removably receive and hold a stem of a stemware glass through the diagonal radial slit, such that the bottom surface rests on a top surface of a foot of the stemware glass and the internal side edge of the centralized opening surrounds the stem;

wherein the straight radial perforated slit expands to permit that body of the coaster to sit substantially flat on the top surface of the foot of the stemware glass.

2. The coaster of claim 1, wherein the shape of the body is selected from a group consisting of substantially circular, semi-circular, oval, elliptical, triangular, rectangular, pentagonal, trapezoidal, rhombus, hexagonal, heptagonal, and octagonal.

3. The coaster of claim 1, wherein the shape of the centralized opening is selected from a group consisting of substantially circular, semi-circular, oval, elliptical, triangular, rectangular, pentagonal, trapezoidal, rhombus, hexagonal, heptagonal, and octagonal.

4. The coaster of claim 1, wherein the body is composed of a fluid absorbing material.

5. The coaster of claim 1, wherein the body is composed of absorbing material selected from the group consisting of paper, cardboard, cork, wood, wood pulp, cotton, felt, cloth, rubber, sponge, and synthetic fibers.

6. The coaster of claim 1, wherein the top surface comprises printed indicia selected from the group consisting of pictures, logos, colors, cartoon images, photographic images, game images, reflective materials, florescent materials, and advertisements.

7. The coaster of claim 1, wherein the bottom surface comprises printed indicia selected from the group consisting of pictures, logos, colors, cartoon images, photographic images, game images, reflective materials, florescent materials, and advertisements.

8. The coaster of claim 1, wherein the coaster is configured to fit all stemware.

9. The coaster of claim 1, wherein the coaster is re-useable.

10. The coaster of claim 1, wherein the coaster is disposable after one use.

11. A coaster for cradling the stem of a glass, the coaster comprising:

a substantially planar, absorbent, and portable body with a substantially flat top surface, a substantially flat bottom surface, and an external side edge;

the coaster further comprising a centralized cavity with an internal side edge;

a substantially diagonal radial channel extending from a first opening on the external side edge to a second opening the internal side edge into the centralized cavity;

at least one substantially straight radial perforated channel extending from the internal side edge of the centralized cavity to a position on the body of the coaster between the external side edge and the internal side edge of the centralized cavity;

wherein the centralized cavity is configured to removably receive and hold a stem of a stemware glass through the diagonal radial channel, such that the bottom surface of the coaster rests on a top surface of a foot of the stemware glass and the internal side edge of the centralized cavity surrounds the stem;

wherein the straight radial perforated channel expands to permit that body of the coaster to sit substantially flat on the top surface of the foot of the stemware glass.

12. The coaster of claim 1 further comprising a plurality of channels positioned on said top surface and said bottom surface, said plurality of channels extend radially from said interior cavity across the length of said top surface and said bottom surface.

13. The coaster of claim 11, wherein the shape of the body is selected from a group consisting of substantially circular, semi-circular, oval, elliptical, triangular, rectangular, pentagonal, trapezoidal, rhombus, hexagonal, heptagonal, and octagonal.

14. The coaster of claim 11, wherein the shape of the centralized cavity is selected from a group consisting of substantially circular, semi-circular, oval, elliptical, triangular, rectangular, pentagonal, trapezoidal, rhombus, hexagonal, heptagonal, and octagonal.

15. The coaster of claim 11, wherein the body is composed of a fluid absorbing material.

16. The coaster of claim 11, wherein the body is composed of absorbing material selected from the group consisting of paper, cardboard, cork, wood, wood pulp, cotton, felt, cloth, rubber, sponge, and synthetic fibers.

17. The coaster of claim 11, wherein the top surface comprises printed indicia selected from the group consisting of pictures, logos, colors, cartoon images, photographic images, game images, reflective materials, florescent materials, and advertisements.

18. The coaster of claim 11, wherein the bottom surface comprises printed indicia selected from the group consisting of pictures, logos, colors, cartoon images, photographic images, game images, reflective materials, florescent materials, and advertisements.

19. The coaster of claim 11, wherein the coaster is configured to fit all stemware.

20. The coaster of claim 11, wherein the coaster is re-useable.

21. The coaster of claim 11, wherein the coaster is disposable after one use.

* * * * *